United States Patent [19]

Ishikawa et al.

[11] Patent Number: 5,012,984

[45] Date of Patent: May 7, 1991

[54] PROCESS FOR PRODUCTION OF COAL-WATER MIXTURE

[75] Inventors: Hiroshi Ishikawa, Zama; Kazuo Koyata, Sagamihara; Tetsuo Ono, Fujisawa; Takuo Motizuki, Niigata; Masayuki Sakuta, Ichikawa; Show Onodera, Nishinomiya; Hiroshi Yanagioka; Yoshihisa Abe, both of Yokohama, all of Japan

[73] Assignees: Central Research Institute of Electric Power Industry, Osaka; Mixed Air Jet Pump Kaihatsu Co., Ltd., Niigata; Nippon Oil and Fats Co., Ltd., Tokyo; Chiyoda Corporation, Kanagawa, all of Japan

[21] Appl. No.: 488,557

[22] Filed: Mar. 5, 1990

[30] Foreign Application Priority Data

Mar. 6, 1989 [JP] Japan ..... 1-51866

[51] Int. Cl.[5] ..... B02C 23/24

[52] U.S. Cl. ..... 241/16; 241/17; 241/18; 241/23

[58] Field of Search ..... 241/16, 17, 18, 23

[56] References Cited

U.S. PATENT DOCUMENTS

| | | | |
|---|---|---|---|
| 4,104,035 | 8/1978 | Cole et al. . | |
| 4,217,109 | 8/1980 | Siwersson et al. . | |
| 4,302,212 | 11/1981 | Yamamura et al. . | |
| 4,358,293 | 11/1981 | Mark . | |
| 4,441,887 | 4/1984 | Funk . | |
| 4,706,891 | 11/1987 | Nakoji et al. | 241/16 |
| 4,786,289 | 11/1988 | Shoji et al. | 241/16 X |

FOREIGN PATENT DOCUMENTS 62-223296 1/1987 Japan .

*Primary Examiner*—Timothy V. Eley
*Attorney, Agent, or Firm*—Armstrong, Nikaido, Marmelstein, Kubovcik & Murray

[57] ABSTRACT

A process for the production of a coal-water mixture, which comprises dry-pulverizing coal under supply of hot air to form pulverized coal in which the proportion of particles having a particle size smaller than 200 μm is at least 90%, in which the proportion of particles having a particle size smaller than 10 μm is 10 to 60%, and making the pulverized coal and the hot air sucked in a mixed-air water jet stream.

3 Claims, 2 Drawing Sheets

PROCESS FOR PRODUCTION OF COAL-WATER MIXTURE

BACKGROUND OF THE INVENTION

The present invention relates to a process for the production of a coal-water mixture.

A coal-water mixture (abbreviated to CWM hereinbelow) can be transported through a pipe like liquid fuel and the mixture is widely used as a fuel for a boiler or a thermal power plant.

In the production of CWM, it is important that the coal is pulverized to yield a particle size distribution such that small coal particles fit into spaces among large coal particles. The processes for producing CWM are classified into the dry process, the wet process and the combined dry-wet process.

According to the dry process, pulverized coal particles differing from one another in the particle size, are produced by dry pulverization using a plurality of pulverizers. These particles are mixed together by controlling the mixing ratio so as to obtain a necessary particle size distribution. Water is added to the mixture and the mixture is kneaded to obtain CWM.

This process is advantageous in that the power cost for the pulverization is small because the pulverization is carried out in a dried state, but the pulverized coal shows such a strong water repellency and kneading thereof with water is relatively difficult, because drying is conducted at the same time with the pulverization. Therefore, the dry process is defective in that a long time and a large amount of power are necessary for the kneading operation.

According to the wet process, in order to eliminate the defect of the dry process, that is, the difficulty in kneading pulverized coal with water, water is added to the coal and pulverization and kneading are simultaneously carried out to attain the production of CWM at once.

However, in the wet process, since pulverization and kneading are simultaneously carried out, the pulverization process is slow and a long time is necessary for the completion of the operation. Furthermore, since large quantities of balls etc. must be used as tumbling agents to pulverize the coal, the power consumption for the pulverization drastically increases. Moreover, this process is disadvantageous over the dry process in that a complicated mill has to be used, the equipment cost increases and it is technically difficult to carry out the operation on a large scale.

Still further, the particle size adjustment for interposing smaller coal particles among coal particles, which is necessary for the production of a high-concentration slurry comprising fine particles of coal dispersed in water at a concentration of about 70%, is difficult in the wet process.

As means for overcoming these disadvantages, there has been proposed a two-step pulverizing method in which wet pulverization is carried out once at a relatively low concentration as the preliminary pulverization step and water is removed from the pulverization product before wet pulverization is carried out again to prepare CWM.

Although this two-step pulverization method attempts to mitigate the long pulverization time and large power consumption involved in the one-step pulverization method substantial benefits are not realized because it becomes necessary to add a dehydrating step prior to the second pulverization step.

The combined dry-wet process is an attempt to overcome the defects o both the dry and wet processes. According to this process, pulverized coal particles differing from one another in particle size are produced by both the dry and wet pulverization processes, and both the coal particles are combined together and kneaded to prepare CWM.

Although the problems of each of the dry and wet processes can be solved to some extent by the combined dry-wet process, the defects of the dry and wet processes remain to a certain extent.

Each of the three foregoing processes for the production of CWM has its own defects, and none of them has been established as an industrial process for the production of CWM.

Under these circumstances, manufacturers are now developing elaborate and unique processes and apparatus of their own.

For example, some of the present inventors proposed a process in which pulverized coal having a predetermined particle size, which has been obtained through the dry pulverization process and the particle size adjustment, is incorporated into a mixed-air jet pump (MJP) water stream to prepare CWM (see Japanese Patent Application Kokai Publication No. 62-223296).

In this process, pulverized coal in hot air, the particle size of which has been adjusted, is collected by gas-solid separation using a pulverized coal collector such as a bag filter, stored in a pulverized coal bin and introduced into an MJP water stream. Accordingly, this process is defective in that the equipment cost is relatively high and a large area is necessary for setting the bag filter.

Moreover, in an ordinary dry coal pulverizing mill, the quantity of hot air used for drying and classification of the coal is so large that the power consumption and equipment cost of fans cannot be neglected.

Furthermore, since the strong water repellency of the pulverized coal cannot be eliminated by the incorporation thereof into an MJP water stream, any homogeneous high-concentration slurry cannot be stably obtained.

SUMMARY OF THE INVENTION

It is a primary object of the present invention to provide a process by which the particle size of pulverized coal obtained by the dry pulverization process can be more easily adjusted to a predetermined value and CWM can be more easily produced while controlling the strong water repellency of the dry pulverized coal.

A second object of the present invention is to provide a process for the production of CWM in which the equipment cost and the power consumption for hot air can be reduced.

A third object of the present invention is to provide a process for the production of CWM in which the electric power consumption can be reduced, the scale of the equipment can be easily increased and the plottage can be reduced.

In accordance with the present invention, these objects can be attained by dry-pulverizing coal under supply of hot air to form pulverized coal in which the proportion of particles having a particle size smaller than 200 μm is at least 90%, in which the proportion of particles having a size smaller than 10 μm is 10 to 60%, and making the pulverized coal and the hot air sucked in an MJP water stream.

DETAILED DESCRIPTION OF THE PREFERRED EMBODIMENTS

The present invention will now be described in detail with reference to the embodiment illustrated in the accompanying drawings.

Figure 1:
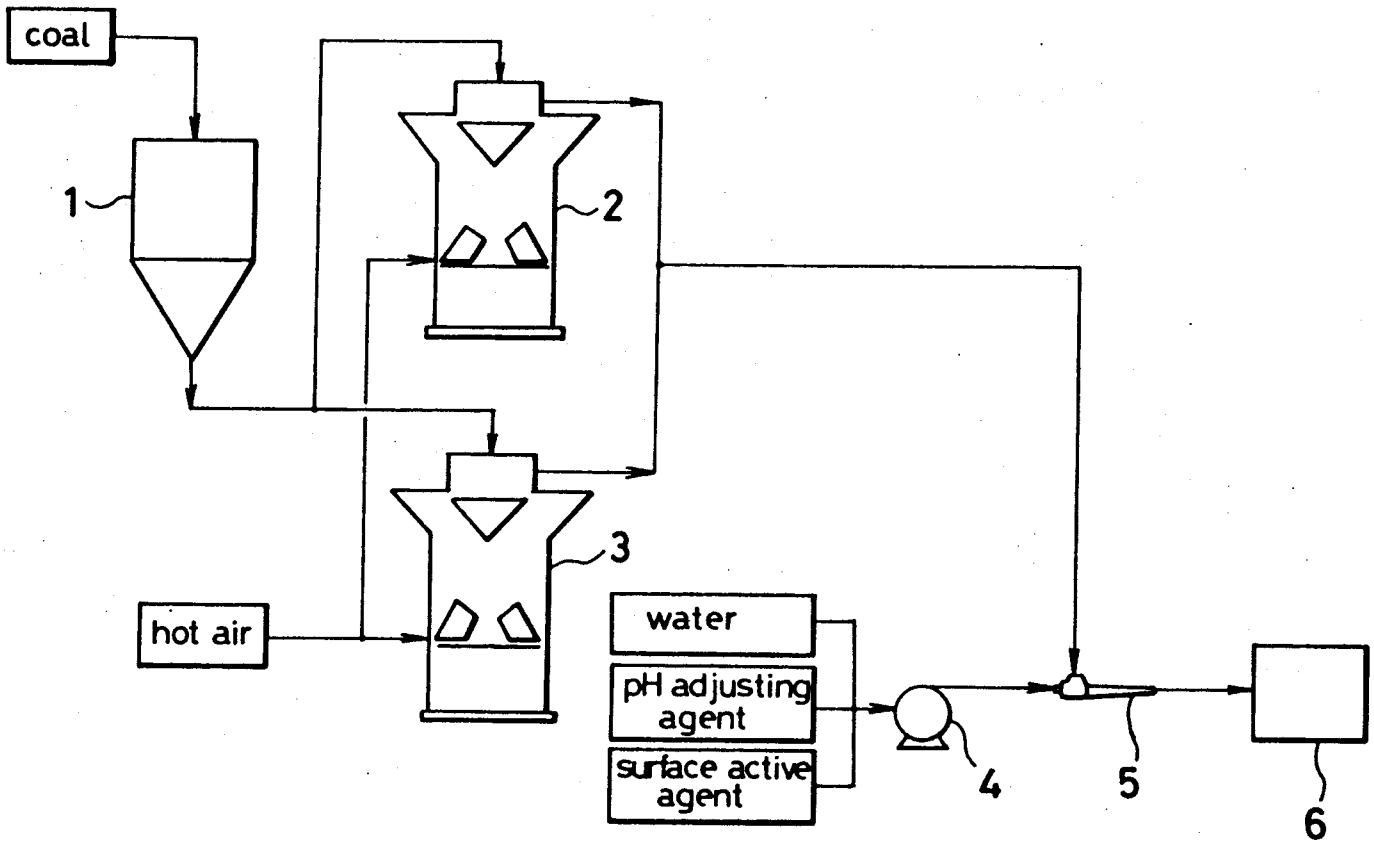
FIG. 1 is a process diagram illustrating an embodiment of the present invention.

As shown in FIG. 1, coal is supplied into a dry pulverizer through a bunker 1 and is pulverized.

As the dry pulverizer, there can be used, for example, a coarse mill 2 and a fine mill 3. Hot air is sucked and supplied into these mills by a vacuum generated by an MJP 5. Coal is dried and pulverized by this hot air, and the particle size is adjusted by gas flow classifiers arranged in the interiors of the mills. Thus, powdered coals differing in the particle size distribution are obtained from the coarse mill 2 and fine mill 3.

These two powdered coals are carried and delivered by hot air coming from the mills 2 and 3, and simultaneously, they are homogeneously mixed with each other to obtain a mixture of the hot air with the pulverized coal having the particle size adjusted such that the proportion of particles having a particle size smaller than 200 μm is at least 90% and the proportion of particles having a particle size smaller than 10 μm is 10 to 60%.

Any of brown coal, subbituminous coal, bituminous coal and anthracite can be used as the coal in the present invention. In order to obtain a high-concentration slurry, the use of bituminous coal or anthracite having a low water content is preferable.

The temperature of the hot air used for drying and classifying the coal is generally 150° to 300° C., and preferably, the quantity of the hot air for delivery of the coal is 0.2 to 0.6 part by weight per part by weight of the coal.

In an ordinary dry coal pulverizing mill, the hot air is used in an amount of 2 to 10 parts per part by weight of the coal. Accordingly, in the present invention, the cost of the hot air can be significantly lowered.

Since the amount of the hot air is small, the quantity of coarse coal particles to be returned to the pulverizing mill by the classifier is increased. Thus the pulverized coal having such a particle size distribution that the proportion of particles having a particle size smaller than 10 μm is 10 to 60% can be easily obtained.

Although in the embodiment shown in FIG. 1, two pulverized coals differing from each other in the particle size distribution are obtained by using the coarse mill 2 and fine mill 3 and these coals are mixed together, the present invention is not limited to this embodiment. Indeed, whenever pulverized coal having the predetermined particle size distribution can be obtained, the use of one mill will suffice, or there may be adoted a method in which at least three mills are used and the pulverized coals are mixed with one another.

The above-mentioned mixture of the hot air with the pulverized coal having the particle size adjusted is supplied into an MJP water stream and is mixed with gas-containing water to form a gas-liquid-solid mixture.

Figure 2:
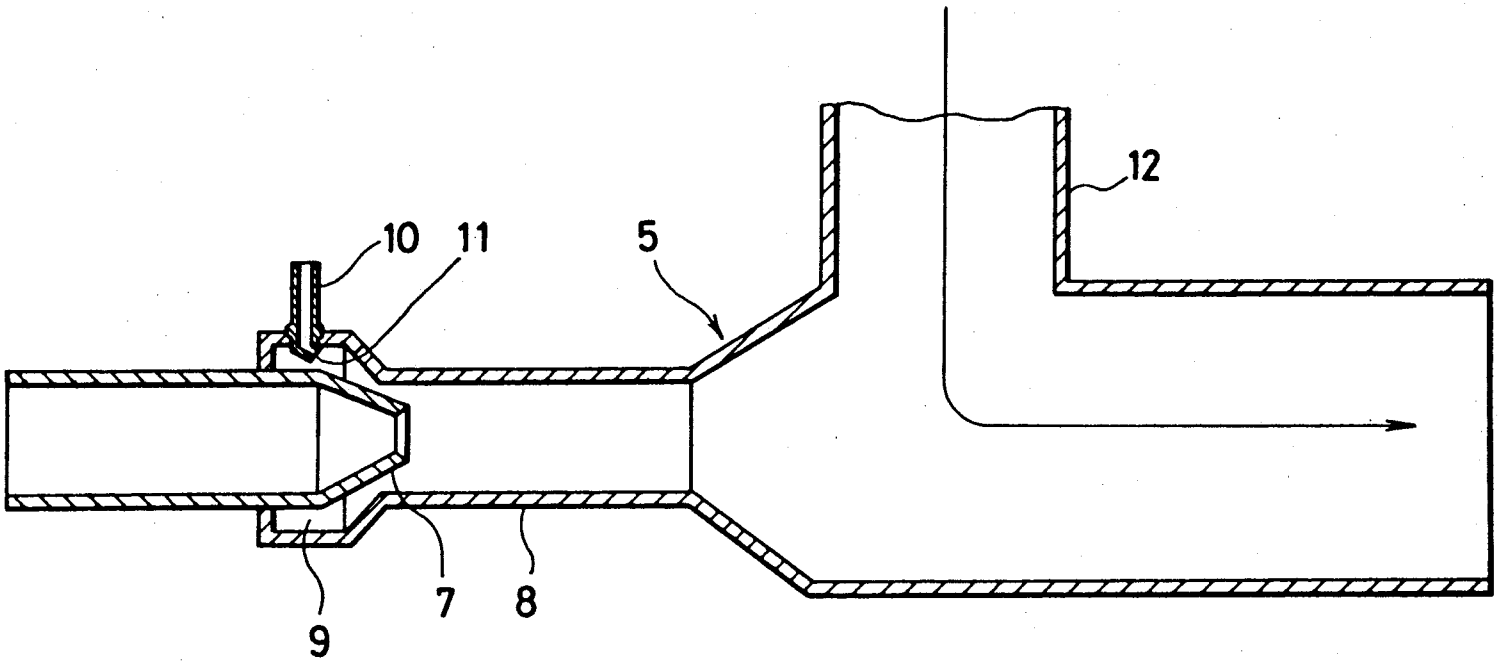
FIG. 2 is a partial side view of the longitudinal section of an example of the MJP used in the present invention.

The MJP water stream can be formed by using a jet pump having the ability to incorporate a gas in high-pressure jetted water. For example, a jet nozzle (MJP) 5 for the fluid delivery, as disclosed in Japanese Patent Publication No. 56-13200, which is shown in FIG. 2, can be used.

In the MJP 5, a driving water supply nozzle 7 is connected to a jet stream protecting tube 8 having an inner diameter larger than the outer diameter of the supply nozzle 7 through an air-introducing space 9. An air-introducing tube 10 is attached to one side of the space 9. In this FIG. 2, the reference numeral 11 represents a check valve.

When this MJP 5 is used, a gas can be spontaneously sucked from the vicinity of the driving water supply nozzle 7 for jetting water to form a mixed stream of the gas and water, and the pulverized coal and the hot air can be sucked through a suction pipe 12 by a vacuum generated by this mixed stream.

Even if the jetting speed of driving water is increased, no cavitation phenomenon is caused in the outer peripheral portion of the water-jetting nozzle, and therefore the sucking force can be elevated to an optional level. If the sucking force is increased, the action of kneading the mixed gas stream with the sucked pulverized coal is increased, so that the pulverized coal can be efficiently dispersed in a small amount of water.

As the driving water for the MJP 5, water is ordinarily supplied to the pump 5 by means of a high pressure pump 4. According to a preferred embodiment, water having a surface active agent incorporated therein is supplied to the pump 4, and most preferably, water having a pH value adjusted by the addition thereto of a pH adjusting agent and a surface active agent is used.

The addition of a surface active agent makes it possible to obtain a slurry having a given water content and a low viscosity, for example, high-concentration CWM having a viscosity of about 1000 cP, which is regarded as the limit for the delivery by a pump.

When the pH value of CWM is adjusted by adding a pH adjusting agent, the function of the surface active agent to disperse the pulverized coal can be sufficiently exerted.

Any of cationic, anionic, nonionic and amphoteric surface active agents may be used as the surface active agent, among which anionic and nonionic surface active agents are especially preferably used.

Examples of the anionic surface active agent which can be used include ligninsulfonic acid salts, naphthalenesulfonic acid salts, alkylnaphthalenesulfonic acid salts, alkylbenzenesulfonic acid salts, formaldehyde condensates of these sulfonic acid salts, polyoxyalkylene alkylphenyl ether sulfates, polyoxyalkylene alkyl ether sulfates, polyoxyalkylene polyhydric alcohol ether sulfates, alkyl sulfate salts, fatty acid salts, polyacrylic acid salts, polymethacrylic acid salts, polystyrenesulfonic acid salts, and salts of copolymers of a polymerizable carboxylic acid (such as acrylic acid, methacrylic acid or maleic anhydride) with a vinyl compound (such as an α-olefin or styrene).

Examples of the nonionic surface active agent which can be used include polyoxyalkylene alkyl ethers, polyoxyalkylene alkylamines, polyoxyalkylene fatty acid amides, polyoxyalkylene polyhydric alcohol ethers, polyoxyalkylene fatty acid esters, polyoxyalkylene polyhydric alcohol fatty acid esters and polyhydric alcohol fatty acid esters.

Alkylbetaines and alkylglycines can be used as the amphoteric surface active agent.

Examples of the cationic surface active agent which can be used include quaternary ammonium salts such as alkyltrimethylammonium halides, dialkyldimethylammonium halides, trialkylmethylammonium halides, alkyldimethylbenzylammonium halides, alkylpyridinium halides and alkylquinolium halides, and amine salts such as amine acetates and amine hydrohalides.

The amount of the surface active agent used depends on whether or not it is used in combination with an alkaline substance as the pH adjusting agent which will be described hereinafter. It is preferred that the surface active agent be used in an amount of 0.05 to 3% by weight, especially 0.1 to 1% by weight, based on the coal in the mixture.

If the amount of the surface active agent used is too small and below the above-mentioned range, no sufficient dispersion can be attained and any high-concentration slurry cannot be obtained. On the contrary, if the amount of the surface active agent is too large and exceeds the above-mentioned range, no further improvement in the pulverized coal dispersing effect can be expected and the process becomes economically disadvantageous.

If an alkaline substance is used in combination with the surface active agent, the amount of the surface active agent can be reduced.

Although a mixture comprising a plurality of surface active agents can be used, the combined use of a cationic surface active agent and an anionic surface active agent should be avoided, and surface active agents should be combined so that the stability of the pulverized coal slurry and the effect of reducing the viscosity are not reduced.

In the present invention, alkaline substances such as sodium hydroxide, potassium hydroxide, calcium hydroxide, ammonia or lower amines can be used as the pH adjusting agent.

The amount of the alkaline substance added is such that the pH value of the slurry is 3 to 12, preferably 6 to 10. In other words, the amount of the alkaline substance is 0.02 to 2% by weight, preferably 0.04 to 0.5% by weight, based on the coal in the mixture.

If this amount is too small and below the above-mentioned range, the dispersing capacity of the surface active agent is not sufficiently attained and any high-concentration slurry cannot be obtained. On the contrary, if it is too large and exceeds the above-mentioned range, no further improvement in the effect can be expected, so that the process becomes economically disadvantageous and a combustion furnace is corroded because of a high pH value in the combustion of the slurry.

The method of using the surface active agent and the pH adjusting agent is not particularly critical. However, there is generally adopted a method in which they are added prior to the supply to the pump 4 as shown in FIG. 1, a method in which these agents are added into driving water of the MJP 5 in advance, or a method in which these agents are added to coal.

Examples of the gas used for the delivery of the pulverized coal and for the mixing of the coal with water while being spontaneously sucked in the MJP 5 include not only air but also incombustible gases such as nitrogen, carbon dioxide, helium and xenon. From the economic viewpoint, the use of air, nitrogen or carbon dioxide is preferable.

The gas-solid-liquid mixture is supplied into a gas-solid-liquid separator 6, and desired CWM is obtained at the bottom of the separator 6.

The present invention will now be described in detail with reference to the following Example.

EXAMPLE

CWM was produced according to the steps shown in FIG. 1.

At first, coal (Saxonvale coal) was supplied at a predetermined ratio (2/1) to a coarse mill 2 at a feed rate of 28 kg/hr and a fine mill 3 at a feed rate of 14 kg/hr from a coal bunker 1 (having a capacity of 2 $m^3$), and the coal was dried by hot air sucked by an MJP 5 and simultaneously dry-pulverized. The particle size of the pulverized coal was adjusted by gas flow classifiers arranged in the interiors of the mills. Thus, two kinds of pulverized coals differing from each other in the particle size distribution were produced at a total rate of 40 kg/hr.

The pulverized coals were carried on a hot air flow and simultaneously were homogeneously mixed, whereby there was obtained pulverized coal in which the proportion of particles having a particle size smaller than 200 $\mu$m was at least 98%, in which the proportion of particles having a particle size smaller than 10 $\mu$m was 36%. The flow rate of the hot air was about 15 $Nm^3$/hr.

The mixture of the pulverized coal with the air was supplied into an MJP water stream to obtain a gas-solid-liquid mixture.

The driving water of the pump 5 was high-pressure water (10 l/hr) of a pH of 9 containing sodium salt of a naphthalenesulfonic acid/formaldehyde condensate and sodium hydroxide in amounts of 0.9% by weight and 0.1% by weight as effective components based on the coal, respectively. While a small amount of air was sucked from the vicinity of the nozzle, the pulverized coal was kneaded with the high-speed MJP water stream. The resulting gas-solid-liquid mixture was introduced into a gas-solid-liquid separator 6 and CWM was obtained from the bottom thereof.

The obtained CWM had a concentration of 70.3% and a viscosity of 962 cP at 20° C. Even after the storage for 2 weeks, no sedimentation of the coal was observed to reveal that the CWM is a stable fluid.

As is apparent from the foregoing description, according to the present invention, since the pulverized coal can be incorporated together with the hot air into an MJP water stream, a bag filter or the like can be omitted and the equipment cost can be reduced. Moreover, since the coal can be pulverized and classified by using the hot air in an amount smaller than that in the conventional dry pulverizing mill, the cost of the hot air can be reduced.

Furthermore, since the pulverized coal is incorporated in an MJP water stream having a surface active agent incorporated therein and having a high-speed kneading capacity, slurrying can be accomplished completely in a very short time. Accordingly, the present invention is advantageous in that the energy consumption for slurrying can be reduced.

For example, in the feasibility study of a large-scale apparatus based on the present invention, when the process of the present invention is carried out by using Saxonvale coal, the power consumption is 29 kwh per ton of the slurry. This is an amount which is greatly reduced as compared with the process which requires the production of a slurry according to the wet process.

Moreover, since the coal is pulverized according to the dry process, the power consumption can be reduced as compared with the process which requires the conventional wet pulverization process using large balls. The scale of the process can also easily be increased. Still further, since the pulverizer is of a longitudinal type, it can be constructed at a small plottage.

Since the dry pulverizer does not have any special structure unlike the wet pulverizer, the equipment cost can be reduced.

In the coal-water mixture of the present invention, though the coal concentration is as high as about 70%, the coal can be stably suspended in water and solid coal can be handled as if it were a fluid.

Therefore, the coal-water mixture obtained according to the present invention can be used as fuel as conveniently as heavy fuel oil.

What is claimed is:

1. A process for preparing a coal-water mixture, which comprises:

dry pulverizing coal in the presence of 0.2 to 0.6 parts by weight of air, at a temperature of 150° to 300° C., to form a mixture of the hot air and the pulverized coal, 90% of the pulverized coal has a particle size smaller than 200 μm and 10–60% of the pulverized coal has a particle size smaller than 10 μm;

forming a mixed-air jet water stream by supplying driving water to a mixed-air jet pump;

creating a suction vacuum by conveying the mixed-air jet water stream past an open suction pipe; and sucking the mixture of the pulverized coal and hot air into the mixed-air jet water stream by the suction vacuum, said water of the mixed-air water jet stream containing 0.05 to 3.0% by weight of a surface active agent and 0.02 to 2% by weight of an alkaline pH adjusting agent, based on the weight of coal in the coal-water mixture.

2. A process according to claim 1, wherein the mixture of pulverized coal particles is produced by mixing coarse coal particles and fine coal particles formed by dry pulverization under supply of the hot air.

3. A process according to claim 1, wherein the surface active agent is at least one surface active agent selected from the group consisting of cationic, anionic, nonionic and amphoteric surface active agents.

* * * * *